US010189258B2

(12) United States Patent
Ohara

(10) Patent No.: US 10,189,258 B2
(45) Date of Patent: Jan. 29, 2019

(54) INKJET RECORDING APPARATUS AND INKJET RECORDING METHOD

(71) Applicant: MIMAKI ENGINEERING CO., LTD., Nagano (JP)

(72) Inventor: Eiichi Ohara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/547,811

(22) PCT Filed: Mar. 2, 2016

(86) PCT No.: PCT/JP2016/056373
§ 371 (c)(1),
(2) Date: Aug. 1, 2017

(87) PCT Pub. No.: WO2016/140247
PCT Pub. Date: Sep. 9, 2016

(65) Prior Publication Data

US 2018/0009225 A1 Jan. 11, 2018

(30) Foreign Application Priority Data

Mar. 2, 2015 (JP) ..... 2015-040773

(51) Int. Cl.
*B41J 2/15* (2006.01)
*B41J 2/14* (2006.01)
(Continued)

(52) U.S. Cl.
CPC ..... *B41J 2/15* (2013.01); *B41J 2/2114* (2013.01); *B41J 2/2117* (2013.01); *B41J 11/002* (2013.01); *B41J 19/142* (2013.01); *B41J 25/006* (2013.01)

(58) Field of Classification Search
CPC ..... B41J 2/15; B41J 2/525; B41J 2/235; B41J 2/255; B41J 2/24; B41J 2/14;
(Continued)

(56) References Cited

U.S. PATENT DOCUMENTS

2013/0050368 A1* 2/2013 Lahut ..... B41J 2/155 347/102
2014/0285575 A1* 9/2014 Owaki ..... B41J 2/145 347/40

FOREIGN PATENT DOCUMENTS

JP 2007-144637 6/2007
JP 2014-065287 4/2014

OTHER PUBLICATIONS

"International Search Report (Form PCT/ISA/210)", dated May 10, 2016, with English translation thereof, pp. 1-4.
(Continued)

*Primary Examiner* — Jason S Uhlenhake
(74) *Attorney, Agent, or Firm* — JCIPRNET

(57) ABSTRACT

An inkjet recording apparatus and an inkjet recording method are provided that facilitate designing of units for subsequent treatment in terms of their shapes and/or positions, while suppressing variability in image quality resulting from subsequent treatment. Two or more recording heads are disposed in a staggered arrangement in X and Y directions. The paired units for subsequent treatment are disposed in parallel to each other along the X direction, and the recording heads are interposed between these units. The length of each of the units for subsequent treatment in the X direction is greater than or equal to the ink-dischargeable extent in the X direction of the recording heads in one scan. The recording heads are arranged, so that nozzle groups, from which the droplets of the same color are discharged, are
(Continued)

disposed symmetrically with respect to an intermediary line between the paired units for subsequent treatment.

13 Claims, 11 Drawing Sheets

(51) Int. Cl.

| | |
|---|---|
| ***B41J 2/255*** | (2006.01) |
| ***B41J 25/00*** | (2006.01) |
| ***B41J 2/21*** | (2006.01) |
| ***B41J 11/00*** | (2006.01) |
| ***B41J 19/14*** | (2006.01) |

(58) Field of Classification Search
CPC ..... B41J 2/14008; B41J 2/14016; B41J 2/14024; B41J 2/14201
See application file for complete search history.

(56) References Cited

OTHER PUBLICATIONS

"Search Report of European Counterpart Application", dated Jan. 5, 2018, pp. 1-5.
"Office Action of Japan Counterpart Application," with English translation thereof, dated Jun. 18, 2018, p.1-p.5.
"Office Action of China Counterpart Application, " dated Aug. 2, 2018, with English translation thereof, p. 1-p. 19.

* cited by examiner

INKJET RECORDING APPARATUS AND INKJET RECORDING METHOD

CROSS-REFERENCE TO RELATED APPLICATION

This application is a 371 application of the international PCT application serial no. PCT/JP2016/056373, filed on Mar. 2, 2016, which claims the priority benefit of Japan application no. 2015-040773, filed on Mar. 2, 2015. The entirety of each of the abovementioned patent applications is hereby incorporated by reference herein and made a part of this specification.

TECHNICAL FIELD

This invention relates to an inkjet recording apparatus for and an inkjet recording method for forming an image on a recording medium by discharging ink droplets onto the medium.

BACKGROUND ART

Conventionally, techniques for inkjet recording have been and are being developed in the technical field pertinent to commercial printing. In the inkjet recording, ink droplets are discharged onto a recording medium and subjected to an energy for subsequent treatment so as to fix an image on the recording medium. For example, a known apparatus has a rectangular head holder that holds a plurality of recording heads through which droplets of ultraviolet-curable inks can be discharged, and a pair of ultraviolet light source units disposed at both ends of the head holder (Patent Literature 1).

The generally called multi-pass (or shuttle pass) recording scheme includes "bidirectional recording mode" that allows printing to be performed at high speeds. In this recording mode, an image is formed with ink droplets discharged from a recording head at timings of forward and backward scans being performed. This recording mode, however, may generate variability in image quality (non-uniform image quality) between parts of an image respectively formed in the forward and backward scans.

Patent Literature 2 describes an apparatus equipped with a plurality of recording heads, and filters that transmit therethrough ultraviolet light of a certain wavelength. The recording heads are arranged in stepwise formation, and the filters are arranged likewise correspondingly to the recording heads. It is further described in this patent literature that the ink droplets that have landed on the recording medium in forward and backward scans can be irradiated with ultraviolet light at equal timings, which advantageously suppresses variability in image quality.

CITATIONS LIST

Patent Literatures

Patent Literature 1: Japanese Unexamined Patent Publication No. 2014-065287 (FIG. 2)

Patent Literature 2: Japanese Unexamined Patent Publication No. 2007-144637 (paragraphs [0126]-[0130], FIG. 4)

SUMMARY

Technical Problems

The apparatus described in Patent Literature 2, however, needs to have at least the filters reshaped for any change of the number and/or arrangement of the recording heads. In a case where the recording heads are disposed in a staggered arrangement to increase an area printable in one scan, how to arrange light sources needs to be considered, as well as the shapes of filters. This poses an issue; a unit for subsequent treatment may be intricately designed in the context of a relationship in position with the recording heads.

To address these issues, this invention provides an inkjet recording apparatus and an inkjet recording method that may facilitate designing of a unit for subsequent treatment in terms of its shape and/or position, while suppressing variability in image quality resulting from subsequent treatment.

Solutions to the Problems

This invention provides an inkjet recording apparatus, including: a plurality of recording heads each having at least a nozzle array from which droplets of an ink are discharged; a pair of units for subsequent treatment that apply an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium. Two or more than two of the plurality of recording heads are disposed in a staggered arrangement in the first direction and a second direction intersecting the first direction. The pair of units for subsequent treatment are disposed along the second direction and spaced at an interval with the plurality of recording heads being interposed therebetween. A respective one of the pair of units for subsequent treatment has a length in the second direction greater than or equal to an ink-dischargeable extent in the second direction of the plurality of recording heads in one scan. Two or more than two nozzle arrays of the plurality of recording heads, from which droplets of a same color ink are discharged, are disposed symmetrically with respect to an intermediary line extending along the second direction and passing through center of the interval between the pair of units for subsequent treatment that are spaced apart.

In this aspect of the invention, two or more nozzle arrays, from which droplets of the same color ink are discharged, are disposed symmetrically with respect to the intermediary line extending along the second direction and passing through the center of the interval between the pair of units for subsequent treatment that are spaced apart. In the apparatus thus structured, a distance between the nozzle array on one side of the intermediary line and the unit for subsequent treatment on the other side of the intermediary line may be equal to a distance between the nozzle array on the other side of the intermediary line and the unit for subsequent treatment on the one side of the intermediary line.

In addition to this, a distance between the unit for subsequent treatment and the nozzle array on one side of the intermediary line may be equal to a distance between the unit for subsequent treatment and the nozzle array on the other side of the intermediary line.

This may result in a substantially constant waiting time, regardless of the forward or backward scan being performed, from a point in time when the ink droplets discharged from the nozzle array land on the recording medium to a point in time when the subsequent treatment by the unit for subsequent treatment starts to be exercised for the ink droplets.

Moreover, two or more of the recording heads are disposed in a staggered arrangement, and these two staggered recording heads are located at symmetric positions with respect to the intermediary line.

Therefore, even in case of any change in the arrangement or number of recording heads, two or more staggered recording heads may certainly be symmetric with respect to the intermediary line, and no design change is necessary for subsequent treatment by the paired units.

This may facilitate designing of the units for subsequent treatment in terms of their shapes and/or positions, while suppressing variability in image quality resulting from the subsequent treatment exercised by these units.

Preferably, the plurality of recording heads may include at least a pair of recording heads having two or more than two nozzle arrays disposed in parallel to each other from which droplets of different color inks are discharged, and the two or more than two nozzle arrays in the pair of recording heads may be disposed symmetrically with respect to the intermediary line for each color of the droplets.

In this aspect of the invention, even in a case where different color inks are mixedly used, a substantially constant waiting time may be provided for the same color ink, regardless of the forward or backward scan being performed, from a point in time when the ink droplets discharged from the nozzle array land on the recording medium to a point in time when the subsequent treatment by the unit for subsequent treatment starts to be exercised for the ink droplets.

Preferably, the plurality of recording heads may include a plurality of pairs of recording heads, and one of the pairs of recording heads disposed more downstream in a transport direction (sub scanning direction) may be spaced apart by a longer distance in the first direction (main scanning direction), while the other one of the pairs of recording heads disposed more upstream in the transport direction may be spaced apart by a shorter distance in the first direction.

In this aspect of the invention, the paired recording heads spaced apart by a longer distance in the first direction are located at positions farther from the intermediary line and closer to the unit for subsequent treatment. This may result in a shorter waiting time from a point in time when the ink droplets discharged from the nozzle array land on the recording medium to a point in time when the subsequent treatment by the unit for subsequent treatment starts to be exercised. As a result, the flow of ink droplets that have landed on the recording medium may be comparatively decreased.

Therefore, one of the pairs of recording heads more spaced apart than the other in the first direction is disposed downstream in the transport direction so as to reduce the flow of ink droplets forming an upper image layer. Then, a sharp and clear matte image may be obtained.

Preferably, the plurality of recording heads may include a plurality of pairs of recording heads, and one of the pairs of recording heads disposed more downstream in the transport direction (sub scanning direction) may be spaced apart by a shorter distance in the first direction (main scanning direction), while the other one of the pairs of recording heads disposed more upstream in the transport direction may be spaced apart by a longer distance in the first direction (main scanning direction).

In this aspect of the invention, the paired recording heads spaced apart by a shorter distance in the first direction are located at positions closer to the intermediary line and farther from the unit for subsequent treatment. This may result in a longer waiting time from a point in time when the ink droplets discharged from the nozzle array land on the recording medium to a point in time when the subsequent treatment by the unit for subsequent treatment starts to be exercised. As a result, the flow of ink droplets that have landed on the recording medium may be comparatively increased.

Therefore, one of the pairs of recording heads less spaced apart than the other in the first direction is disposed downstream in the transport direction so as to increase the flow of ink droplets forming an upper image layer. Then, a less grainy, glossy image may be obtained.

Whether a matte or glossy image is obtained is overwhelmingly decided by the condition of droplets on the outermost surface. When one scan forms an image, for example, the image's surface condition changes with the droplets discharged from the recording head disposed downstream in a direction in which the scan is performed. Therefore, an image with different tones may be formed, as described referring to the distance from the recording head downstream in the scan-performing direction to the unit for subsequent treatment.

Preferably, of the nozzle arrays in the pair of recording heads, droplets of a color ink with lower luminosity are discharged from the nozzle array closer to the intermediary line, and droplets of a color ink with higher luminosity are discharged from the nozzle array farther from the intermediary line.

In one of the pair of recording heads disposed upstream in the scan-performing direction, the waiting time to the start of subsequent treatment is shorter with the nozzle array closer to the intermediary line, while the waiting time to the start of subsequent treatment is longer with the nozzle array farther from the intermediary line.

With a substantially short waiting time, the ink droplets are cured soon after they have landed on the recording medium. This may reduce the risk of beading, which is the event that adjacent dots merge into one another, causing variability in image quality. On the other hand, the waiting time, as prolonged, delays curing of the ink droplets that landed on the recording medium, increasing the likelihood of beading.

By discharging droplets of a more visible color ink with lower luminosity from the nozzle array closer to the intermediary line, beading-caused variability in image quality may be less discernible.

The length of waiting time greatly affects the occurrence of beading. The likelihood of beading, therefore, is overwhelmingly controlled by the waiting time to the start of subsequent treatment after the droplets from the recording head upstream, rather than downstream, in the scan-performing direction have landed on the recording medium.

The recording head upstream in the scan-performing direction is located in proximity to the intermediary line so as to reduce the waiting time to the start of subsequent treatment after the ink droplets from the recording head upstream in the scan-performing direction have landed on the recording medium.

Preferably, the plurality of recording heads may include at least one specified recording head having two or more than two nozzle arrays from which droplets of a same color ink are discharged, and the two or more than two nozzle arrays of the at least one specified recording head may be spaced at an interval in parallel to each other in the first direction and may also be disposed symmetrically with respect to the intermediary line.

In this aspect of the invention, two or more nozzle arrays in at least one specified recording head among the plurality of recording heads are disposed symmetrically with respect to the intermediary line. This may facilitate adjustments of positions and orientations of the recording heads, as compared to disposing two or more recording heads symmetrically with respect to the intermediary line.

Preferably, the inkjet printing apparatus may further include a carriage by which the plurality of recording heads and the pair of units for subsequent treatment are securely positioned. The plurality of recording heads and the pair of units for subsequent treatment, thus mounted in the carriage, may be integrally transported.

This invention further provides an inkjet recording apparatus, including: a plurality of recording heads each having at least a nozzle array from which droplets of an ink are discharged; a unit for subsequent treatment that applies an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium. Two or more than two of the plurality of recording heads are disposed in a staggered arrangement in the first direction and a second direction intersecting the first direction. The unit for subsequent treatment is disposed linearly along the second direction. The units for subsequent treatment has a length in the second direction greater than or equal to an ink-dischargeable extent in the second direction of the plurality of recording heads in one scan. Two or more than two nozzle groups of the plurality of recording heads, from which droplets of a same color ink are discharged, are disposed symmetrically with respect to an intermediary line of the unit for subsequent treatment that are spaced apart.

In this aspect of the invention, two or more nozzle arrays, from which droplets of the same color ink are discharged, are disposed symmetrically with respect to the intermediary line of the unit for subsequent treatment. In the apparatus thus structured, a distance between the nozzle group and the unit for subsequent treatment on one side of the intermediary line may be equal to a distance between the nozzle group and the unit for subsequent treatment on the other side of the intermediary line. This may result in a substantially constant waiting time, regardless of the forward or backward scan being performed, from a point in time when the ink droplets land on the recording medium to a point in time when the subsequent treatment starts to be exercised.

Moreover, two or more of the recording heads are disposed in a staggered arrangement, and the nozzle arrays of these two or more staggered recording heads are located at symmetric positions with respect to the intermediary line.

Therefore, even in case of any change in the arrangement and/or number of recording heads, the nozzle arrays of two or more staggered recording heads may certainly be symmetric with respect to the intermediary line, and no design change is necessary for subsequent treatment by the paired units.

This may facilitate designing of the units for subsequent treatment in terms of their shapes and/or positions, while suppressing variability in image quality resulting from the subsequent treatment exercised by these units.

The inkjet recording method according to this invention forms an image on a recording medium using the inkjet recording apparatus according to any one of the aspects described so far.

Effect of the Invention

The inkjet recording apparatus and the inkjet recording method according to this invention may facilitate designing of the units for subsequent treatment in terms of their shapes and positions, while suppressing variability in image quality resulting from subsequent treatment.

DESCRIPTION OF EMBODIMENTS

Hereinafter, embodiments of the inkjet recording apparatus according to this invention that are considered effective in connection with an inkjet recording method are described referring to the accompanying drawings. In this specification, "forming" an image may be rephrased as "recording" or "printing" an image.

First Embodiment

First, an inkjet recording apparatus 10 according to a first embodiment is hereinafter described referring to FIGS. 1 to 4A and 4B.

[Configuration of Inkjet Recording Apparatus 10]

Figure 1:
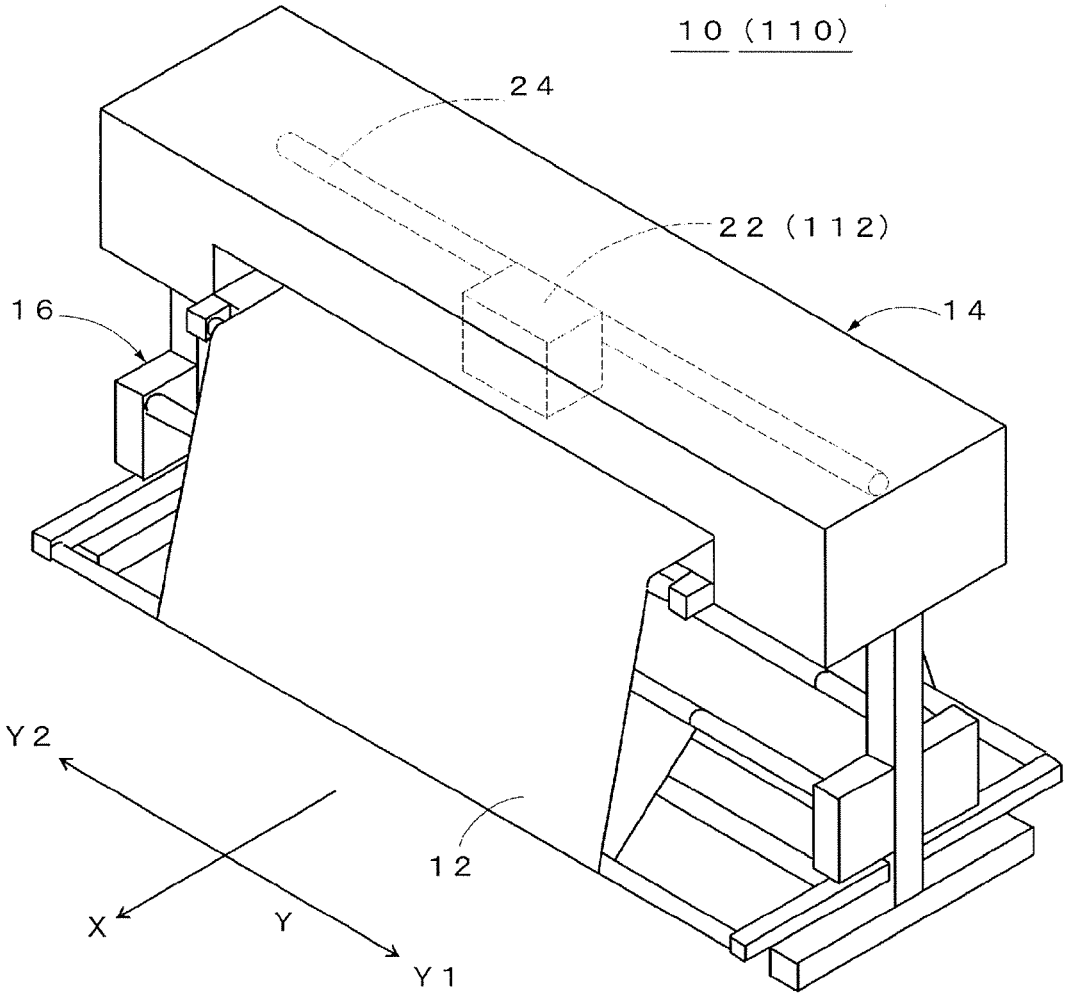
FIG. 1 is a perspective view of an inkjet recording apparatus according to a first embodiment of this invention.
Figure 2:
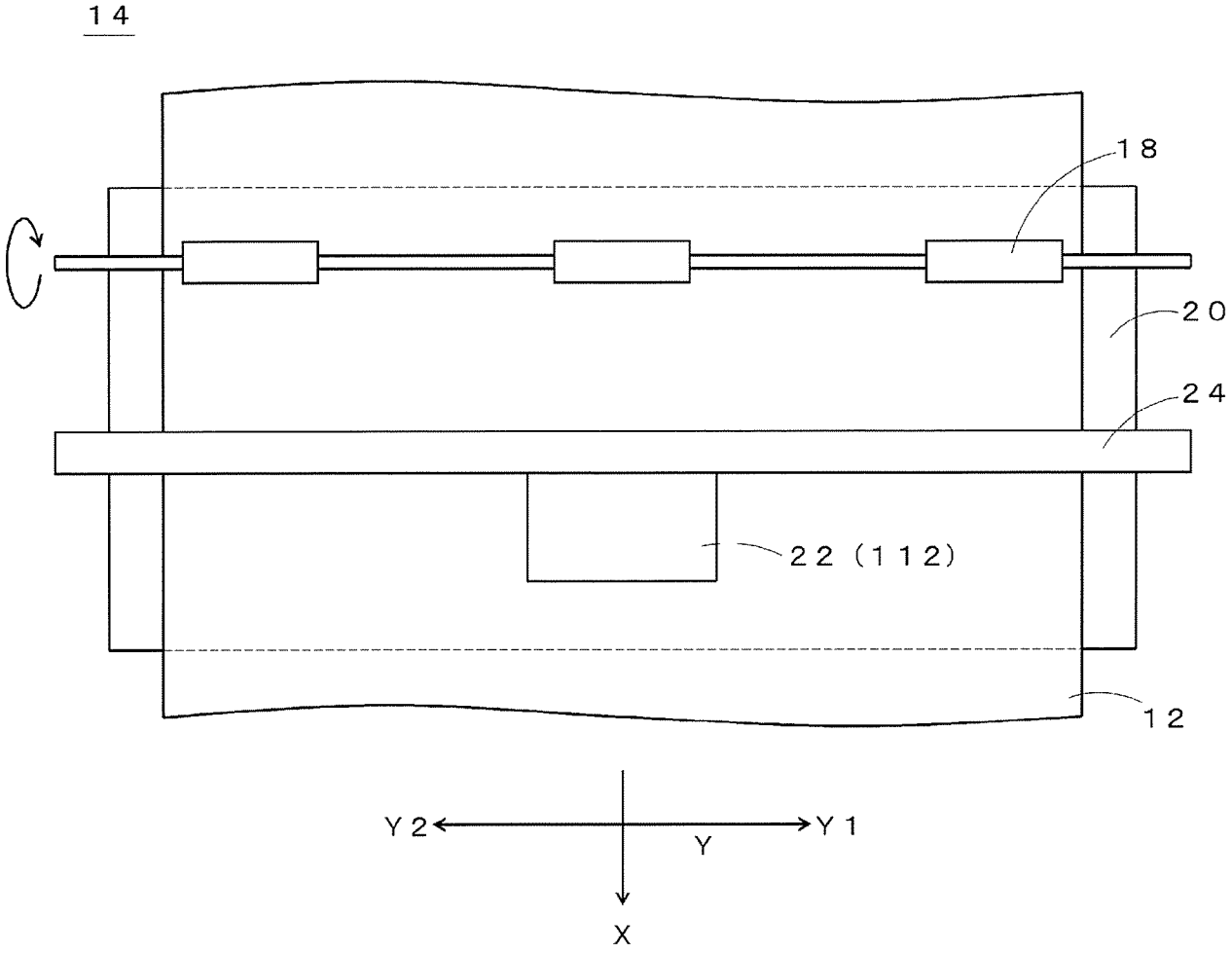
FIG. 2 is an enlarged plan view of a principal part in the inkjet recording apparatus illustrated in FIG. 1.
Figure 3:
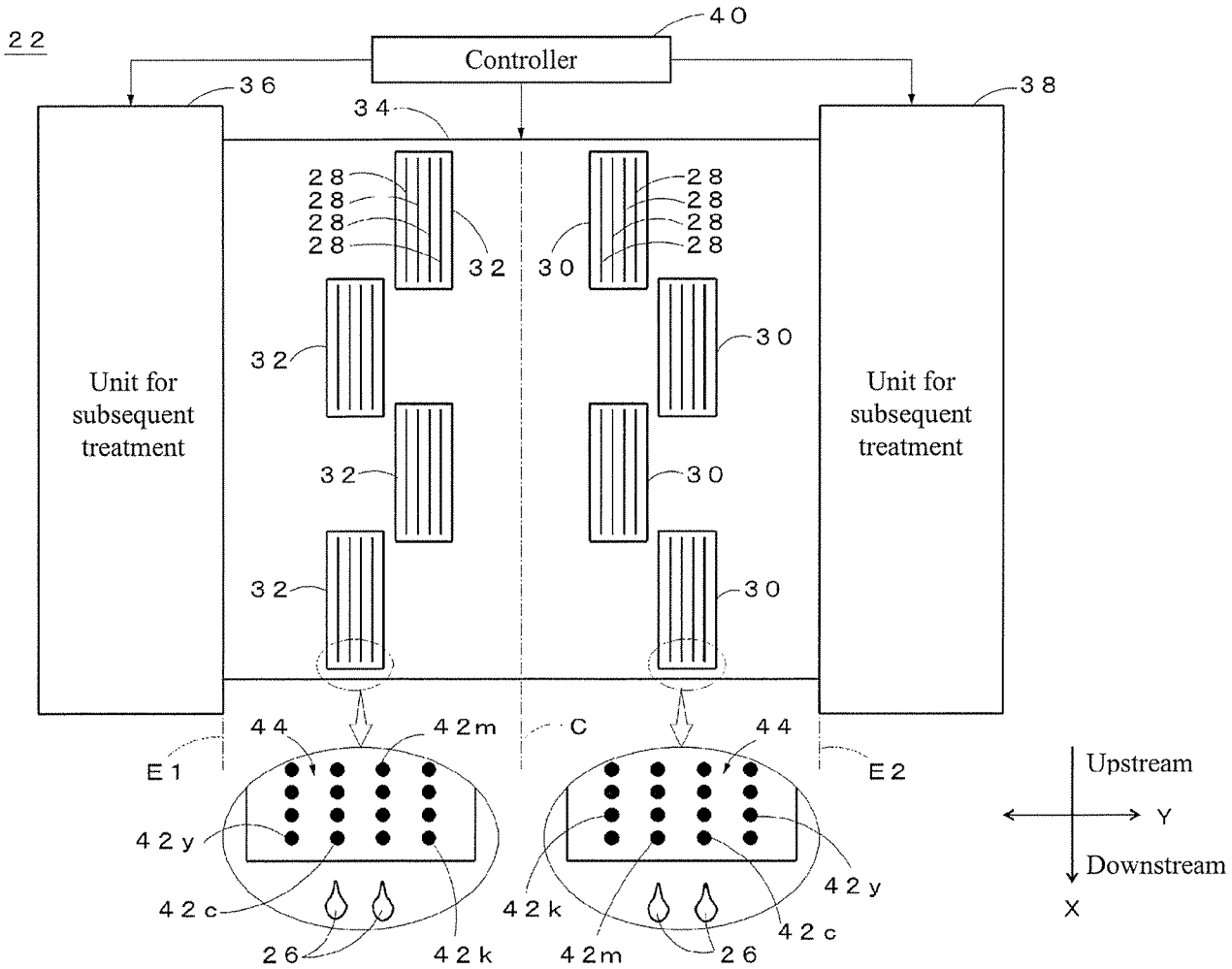
FIG. 3 is an opened-up, schematic plan view of a carriage illustrated in FIGS. 1 and 2.

FIG. 1 is a perspective view of the inkjet recording apparatus 10 according to the first embodiment. FIG. 2 is an enlarged plan view of a principal part in the inkjet recording apparatus 10 illustrated in FIG. 1. FIG. 3 is an opened-up, schematic plan view of a carriage 22 illustrated in FIGS. 1 and 2.

The inkjet recording apparatus 10 is a wide-format printer that forms a color image on a recording medium 12 using ultraviolet-curable inks. The recording medium 12 may be selected from media (pervious or non-pervious) made of various materials, including paper, unwoven cloth, vinyl chloride, synthetic chemical fiber, polyethylene, polyester, and tarpaulin.

As illustrated in FIGS. 1 and 2, the inkjet recording apparatus 10 has, as its basic structural elements, a printer body 14 that performs printing on the rolled recording medium 12, and a take-up device 16 that collects the recording medium 12 on which printing has been performed.

The printer body 14 includes a transport roller 18 that transports the recording medium 12 in X direction (second direction, sub scanning direction), a platen 20 that supports from underneath the recording medium 12 being transported by the rotating transport roller 18, a carriage 22 remotely disposed in the upper direction of the platen 20, and a guide rail 24 that movably supports the carriage 22 in Y direction (first direction, main scanning direction) intersecting the X direction.

The inkjet recording apparatus 10 is configured for, generally called, multi-pass (or shuttle pass) recording scheme. The "multi-pass recording scheme" completes the formation of an image by discharging ink droplets 26 (FIG. 3) in multiple passes to a same position on the recording medium 12 (image region in a given width), while moving the recording medium 12 in the sub scanning direction and reciprocating the carriage 22 in the main scanning direction. In the illustrated example, the Y direction indicating the main scanning direction is orthogonal to the X direction indicating the sub scanning direction.

As illustrated in FIG. 3, inside of the cabinet of the carriage 22, four recording heads 30 and four recording heads 32 each having nozzle arrays 28 from which the ink droplets 26 are discharged are provided. Inside of the cabinet of the carriage 22, a head holder 34 and a pair of units for subsequent treatment 36 and 38 are securely held and housed. The head holder 34 is rectangular in plan view and holds the four recording heads 30 and the four recording heads 32. The units for subsequent treatment 36 and 38 are disposed at both sides of the head holder 34 in the Y direction (main scanning direction).

The recording heads 30 and 32 and the units for subsequent treatment 36 and 38 are electrically connected to a controller 40 installed in the printer body 14. The controller 40 includes CPU (Central Processing Unit) and RAM (Random Access Memory). The controller 40 controls operations, including ink discharge from the recording heads 30 and 32 and light radiation from the units for subsequent treatment 36 and 38.

The recording heads 30 and 32 discharge the droplets 26 of four color inks (C: cyan, M: magenta, Y: yellow, and K: black) from the four nozzle arrays 28 extending in parallel to one another along the X direction (sub scanning direction). Any suitable one of various schemes may be available for discharge of the droplets 26 from the recording heads 30 and 32. For example, the droplets 26 may be discharged through deformation of a piezoelectric device-equipped actuator, or air bubbles may be generated by heating the inks using a heater to pressurize and discharge the droplets 26.

The units for subsequent treatment 36 and 38 are substantially rectangular in plan view, and include light source units that radiate ultraviolet light toward the ink droplets 26 on the recording medium 12. A light source of ultraviolet light may be selected from rare gas discharge lamps, mercury discharge lamps, fluorescent lamps, and LED (Light Emitting Diode) arrays.

The units for subsequent treatment 36 and 38 are disposed in parallel to each other along the X direction (sub scanning direction), and all of the four recording heads 30 and four recording heads 32 are interposed between these units. Hereinafter, an edge of the unit for subsequent treatment 36 closer to the recording heads 32 is referred to as a "treatment-starting line E1", and an edge of the unit for subsequent treatment 38 closer to the recording heads 30 is referred to as a "treatment-starting line E2". A line connecting points that are equally distanced from the treatment-starting lines E1 and E2 is a straight line along the second direction. This straight line is referred to as "intermediary line C" between the units for subsequent treatment 36 and 38.

As is known from the drawing, the recording heads 30 and 32 (eight recording heads in total) are disposed symmetrically with respect to the intermediary line C.

With "a pair" being used to refer to the recording heads 30 and 32 that are symmetric with respect to the intermediary line C and equally positioned in the X direction, there are four "pairs" of recording heads in the head holder 34.

A respective one of the recording heads 30 has, in the order of a position least distant from the intermediary line C to more distant positions, a nozzle array 28 having nozzle holes 42*k* spaced at equal intervals in the X direction from which the black (K) ink droplets 26 are discharged, a nozzle array 28 having nozzle holes 42*m* spaced at equal intervals in the X direction from which the magenta (M) ink droplets 26 are discharged, a nozzle array 28 having nozzle holes 42*c* spaced at equal intervals in the X direction from which the cyan (C) ink droplets 26 are discharged, and a nozzle array 28 having nozzle holes 42*y* spaced at equal intervals in the X direction from which the yellow (Y) ink droplets 26 are discharged.

Hereinafter, the nozzle holes 42*y*, 42*c*, 42*m*, and 42*k* that are two-dimensionally disposed in grid-like fashion may be collectively referred to as "nozzle matrix 44".

Preferably, the ink discharged from the nozzle array 28 nearest to the intermediary line C has lowest luminosity (black (K)), while the ink discharged from the nozzle array 28 farthest from the intermediary line C has highest luminosity (yellow Y)).

The "luminosity" in this description means the degree of color brightness, which is, for example, an index represented by a value between 0 and 100 in the color system including CIELAB and CIELUV.

In the illustrated example, the four recording heads 30 are alternately disposed in two rows along the X direction in a staggered arrangement. The four recording heads 30 are arranged in a manner that an interval in the X direction between the nozzle holes (42*k*, 42*m*, 42*c*, 42*y*) on one end side of the nozzle array 28 in any one of the recording heads 30 and the nozzle holes (42*k*, 42*m*, 42*c*, 42*y*) on the other end side of the nozzle array 28 (side closer to the one recording head 30) in adjacent one of the recording heads 30 is equal to an interval in the X direction between the nozzle holes (42*k*, 42*m*, 42*c*, 42*y*) of the nozzle array 28 in a respective one of the recording heads 30.

The inkjet recording apparatus 10 thus having the recording heads 30 displaced relative to each other in the Y direction may increase a printing region (width in the X direction) obtainable in one scan by the carriage 22.

A respective one of the recording heads 32 has, in the order of a position least distant from the intermediary line C to more distant positions, a nozzle array 28 having nozzle holes 42*k* spaced at equal intervals in the X direction from which the black (K) ink droplets 26 are discharged, a nozzle array 28 having nozzle holes 42*m* spaced at equal intervals in the X direction from which the magenta (M) ink droplets 26 are discharged, a nozzle array 28 having nozzle holes 42*c* spaced at equal intervals in the X direction from which the cyan (C) ink droplets 26 are discharged, and a nozzle array 28 having nozzle holes 42*y* spaced at equal intervals in the X direction from which the yellow (Y) ink droplets 26 are discharged.

That is to say, the nozzle matrix 44 of the recording heads 32 and the nozzle matrix 44 of the recording heads 30 are line-symmetric with respect to the intermediary line C.

Thus structured, the nozzle arrays 28 from which the droplets 26 of the "black (K)" ink are discharged, for example, constitute two nozzle groups 46 and 48 (FIGS. 4A and 4B) of the recording head groups 30 disposed symmetrically with respect to the intermediary line C. The "nozzle group" includes one or more nozzle arrays 28 and is a group of nozzles 42*k* equally spaced in the X direction. This applies to the other three color inks, magenta, cyan, and yellow inks. In this embodiment, the nozzle groups, from which the droplets 26 of the same color are discharged, are disposed symmetrically with respect to the intermediary line C (line symmetry).

The unit for subsequent treatment 36 has a length in the X direction greater than an ink-dischargeable extent in the X direction of the recording heads 30, 32 in one scan. The ink-dischargeable extent corresponds to a distance between the nozzles 42*k* most upstream and most downstream, respectively, in the X direction in two or more recording heads 30 and 32 in one nozzle group 46, 48. As with the unit for subsequent treatment 36, the unit for subsequent treatment 38 has a length in the X direction greater than the ink-dischargeable extent of the recording heads 30, 32.

[Operation of Inkjet Recording Apparatus 10]

The inkjet recording apparatus 10 according to the first embodiment is configured as described so far. Next, the operation of the inkjet recording apparatus 10 is described referring to FIGS. 4A and 4B.

The controller 40 (FIG. 3) converts an image signal inputted from an outer source into desired print data and generates control signals for the recording heads 30 and 32 based on the generated print data. As prompted by the control signals, the inkjet recording apparatus 10 carries out printing operation to form a color image on the recording medium 12.

Prior to the printing operation, a recording mode; unidirectional recording mode or bidirectional recording mode, is selected and set. During the "unidirectional recording mode", the droplets 26 are discharged in forward scans (scans performed in the direction of arrow Y1) by the carriage 22 but are not discharged in backward scans (scans performed in the direction of arrow Y2). During the "bidirectional recording mode", the ink droplets 26 are discharged in forward and backward scans both by the carriage 22.

Figure 4A:
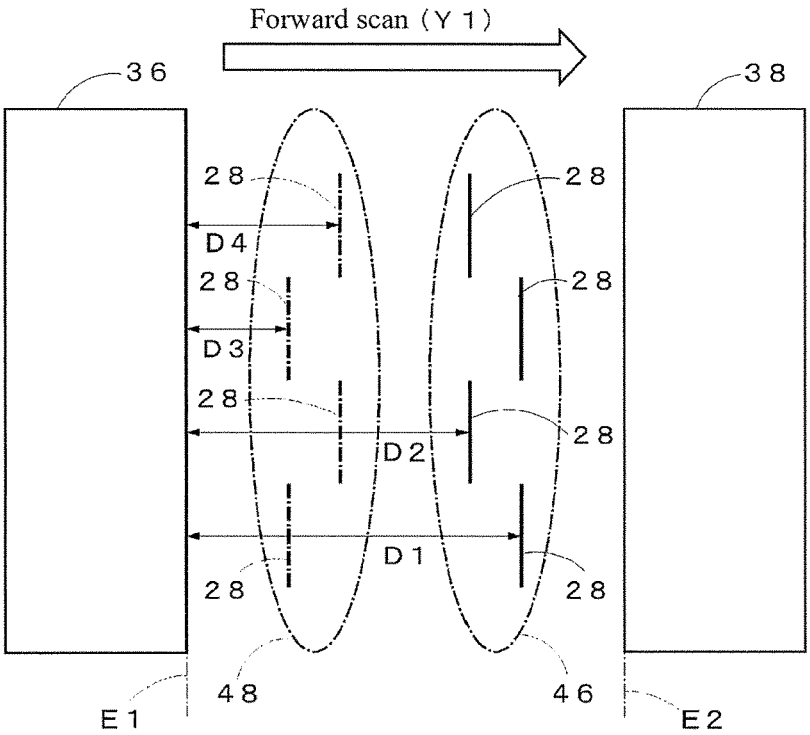
FIGS. 4A and 4B are drawings that illustrate an image formation process in a bidirectional recording mode according to the first embodiment.
Figure 4B:
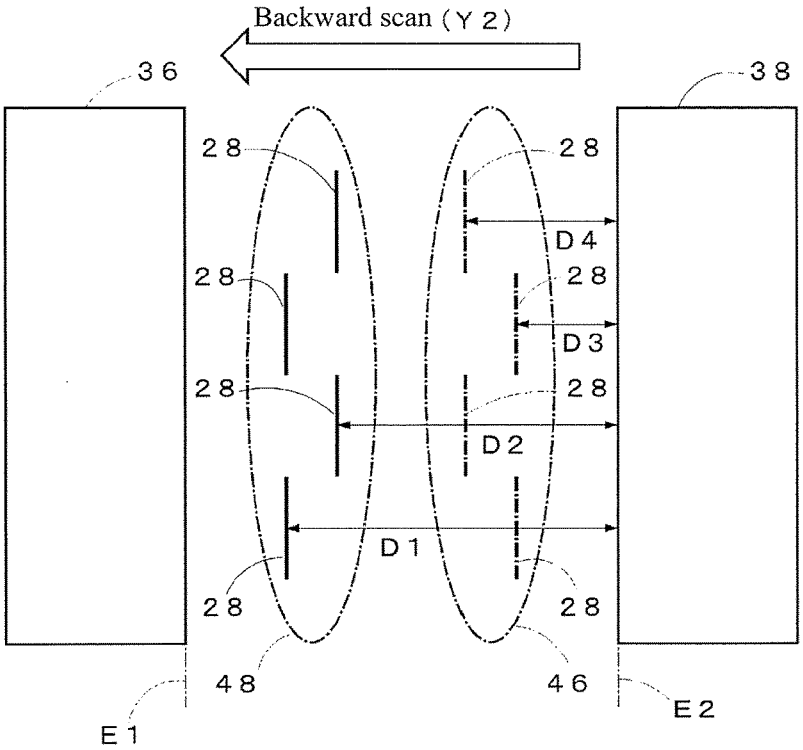

FIGS. 4A and 4B are drawings that illustrate an image formation process in the bidirectional recording mode according to the first embodiment. FIG. 4A is a drawing that illustrates a forward scan (in the direction of arrow Y1). FIG. 4B is a drawing that illustrates a backward scan (in the direction of arrow Y2). These drawings schematically illustrate a relationship in position alone among the units for subsequent treatment 36 and 38 and the nozzle arrays 28 from which the droplets 26 of a certain color (for example, black (K)) are discharged.

In a forward scan (in the direction of arrow Y1), as illustrated in FIG. 4A, the droplets 26 discharged from the nozzle groups 46, 48 land on a surface of the recording medium 12 and spreads on the surface by degrees over time. Then, the carriage 22 moves in the direction of arrow Y1, and the unit for subsequent treatment 36 arrives at the position of the droplets 26 that have landed on the medium. As prompted by an instruction to radiate light outputted from the controller 40, the unit for subsequent treatment 36 irradiates the droplets 26 at the landing position with ultraviolet light to cure the droplets 26 as subsequent treatment.

As per the drawing, D1 represents a distance between the treatment-starting line E1 and the first nozzle array 28 downstream in the X direction of the nozzle group 46, D2 (<D1) represents a distance between the treatment-starting line E1 and the second nozzle array 28 downstream in the X direction of the nozzle group 46, D3 represents a distance between the treatment-starting line E1 and the third nozzle array 28 downstream in the X direction of the nozzle group 48, and D4 (>D3) represents a distance between the treatment-starting line E1 and the fourth nozzle array 28 downstream in the X direction of the nozzle group 48. The carriage 22 moves at a constant speed. Therefore, a waiting time from an ink droplet landing time to a subsequent treatment starting time is longer with the droplets 26 discharged from the nozzle array away by the distance D4 than with the droplets 26 by the distance D3.

As illustrated in FIG. 4B, the droplets 26 discharged from the nozzle group 46, 48 land on a surface of the recording medium 12 and spreads on the surface by degrees over time. Then, the carriage 22 moves in the direction of arrow Y2, and the unit for subsequent treatment 38 arrives at the position of the droplets 26 that have landed on the medium. As prompted by an instruction to radiate light outputted from the controller 40, the unit for subsequent treatment 38 irradiates the droplets 26 at the landing position with ultraviolet light to cure the droplets 26 as subsequent treatment.

There is the distance D1 between the treatment-starting line E2 and the first nozzle array 28 downstream in the X direction of the nozzle group 48, and there is the distance D2 between the treatment-starting line E2 and the second nozzle array 28 downstream in the X direction of the nozzle group 48, which are the same as in the forward scan (FIG. 4A). Similarly, there is the distance D3 between the treatment-starting line E2 and the third nozzle array 28 downstream in the X direction of the nozzle group 46, and there is the D4 between the treatment-starting line E2 and the fourth nozzle array 28 downstream in the X direction of the nozzle group 46, which are the same as in the forward scan (FIG. 4A).

The controller 40 then drives the transport roller 18 to transport the recording medium 12 by one pass in the X direction, and thereafter repeats the operation described above. The inkjet recording apparatus 10, while transporting the recording medium 12 in the transport direction (X direction) and reciprocating the carriage 22 at a constant speed in the main scanning direction (Y direction) intersecting the transport direction, discharges the droplets 26 at timings of the forward (direction of arrow Y1) and backward (direction of arrow Y2) scans being performed to form an image with dots on the recording medium 12.

[Effects of First Embodiment]

The inkjet recording apparatus 10 includes recording heads 30 and 32, paired units for subsequent treatment 36 and 38, and a controller 40. The recording heads 30 and 32 each have two or more nozzle arrays 28 from which the ink droplets 26 are discharged. The units for subsequent treatment 36 and 38 radiate ultraviolet light toward the droplets 26 on the recording medium 12 discharged from the recording heads 30 and 32, thereby carrying out the subsequent treatment on the ink dots. The controller 40 prompts the recording heads 30 and 32, while reciprocating them in the Y direction, to discharge the droplets 26 at timings of the forward and backward scans being performed to form an image with the ink dots on the recording medium 12.

Two or more of the recording heads 30 and 32 are disposed in a staggered arrangement in the X and Y directions.

The paired units for subsequent treatment 36 and 38 are disposed in parallel to each other along the X direction, and the recording heads 30 and 32 are interposed between these units.

The length of each of the units for subsequent treatment 36, 38 in the X direction is greater than or equal to the ink-dischargeable extent in the X direction of the recording heads 30, 32 in one scan.

The recording heads 30 and 32 are arranged, so that two or more nozzle arrays (nozzle groups 46, 48), from which the droplets 26 of the same color (for example, black) are discharged, are disposed symmetrically with respect to the intermediary line C between the units for subsequent treatment 36 and 38.

Thus structured, the distance between the nozzle group 46 and the unit for subsequent treatment 36 and the distance between the nozzle group 48 and the unit for subsequent treatment 38 are equal, and also the distance between the nozzle group 48 and the unit for subsequent treatment 36 and the distance between the nozzle group 46 and the unit for subsequent treatment 38 are equal. That is to say, a substantially constant waiting time is provided, regardless of the forward or backward scan being performed, from a point in time when the ink droplets 26 discharged from the nozzle group (nozzle holes) land on the recording medium 12 to a point in time when the subsequent treatment by the units for subsequent treatment starts to be exercised.

In the inkjet recording apparatus 10, two or more of the recording heads 30 and 32 are disposed in a staggered arrangement. This may ensure symmetry with respect to the intermediary line C.

Even in case of any change in the arrangement and/or number of the recording heads 30 and 32, no design change may be necessary for the subsequent treatment by the units for subsequent treatment 36 and 38.

This may facilitate designing of the units for subsequent treatment 36 and 38 in terms of their shapes and/or positions, while suppressing variability in image quality resulting from the subsequent treatment exercised by the units 36 and 38.

In the nozzle groups 46 and 48, two or more of the recording heads 30 and 32 are disposed in a staggered arrangement. This structural feature may afford reduction in the number of nozzles provided in the recording heads 30 and 32, improving the productivity (for example, yield) of the recording heads 30 and 32.

The recording heads 30, 32 may include at least a pair of recording heads 30, 32 each having two or more nozzle arrays 28 disposed in parallel to each other from which the ink droplets 26 of different colors are discharged, and the pair of recording heads 30 and 32 may be disposed, so that these two or more nozzle arrays 28 in the pair of recording heads are symmetric with respect to the intermediary line C for each color of the droplets 26.

Even in a case where different color inks are mixedly used, since two or more nozzle arrays 28, from which the ink droplets 26 of the same color are discharged, are symmetric with respect to the intermediary line C, a substantially constant waiting time is provided for the same color ink from a point in time when the ink droplets 26 discharged from the nozzle array 28 land on the recording medium 12 to a point in time when the subsequent treatment by the units 36, 38 starts to be exercised.

Of the nozzle arrays in the pair of recording heads 30 and 32, the droplets 26 of a color ink with lower luminosity may be discharged from the nozzle array 28 closer to the intermediary line C, and the droplets 26 of a color ink with higher luminosity may be discharged from the nozzle array 28 farther from the intermediary line C. In one of the pair of recording heads 30 and 32 disposed upstream in the scan-performing direction (Y direction), the waiting time to the start of subsequent treatment is shorter with the nozzle array 28 closer to the intermediary line C, while the waiting time to the start of subsequent treatment is longer with the nozzle array 28 farther from the intermediary line C. A substantially short waiting time may reduce the risk of beading attributed to the spread of the droplets 26. On the other hand, beading is more likely to occur with a longer waiting time. By discharging the droplets 26 of a more visible color ink with lower luminosity from the nozzle array 28 closer to the intermediary line C, beading-caused variability in image quality may be suppressed.

The inkjet printing apparatus 10 may further include the carriage 22 by which the plurality of recording heads 30 and 32 and the pair of units for subsequent treatment 36 and 38 are securely positioned. The recording heads 30 and 32 and the pair of units for subsequent treatment 36 and 38, thus mounted in the carriage, can be integrally transported.

[Modified Examples of First Embodiment]

Next, a modified example of the inkjet recording apparatus 10 according to the first embodiment is hereinafter described referring to FIGS. 5 to 9. The components similar to those described in the first embodiment are indicated with the same reference signs, and description of such like components may be omitted.

[First Modified Example]

Figure 5:
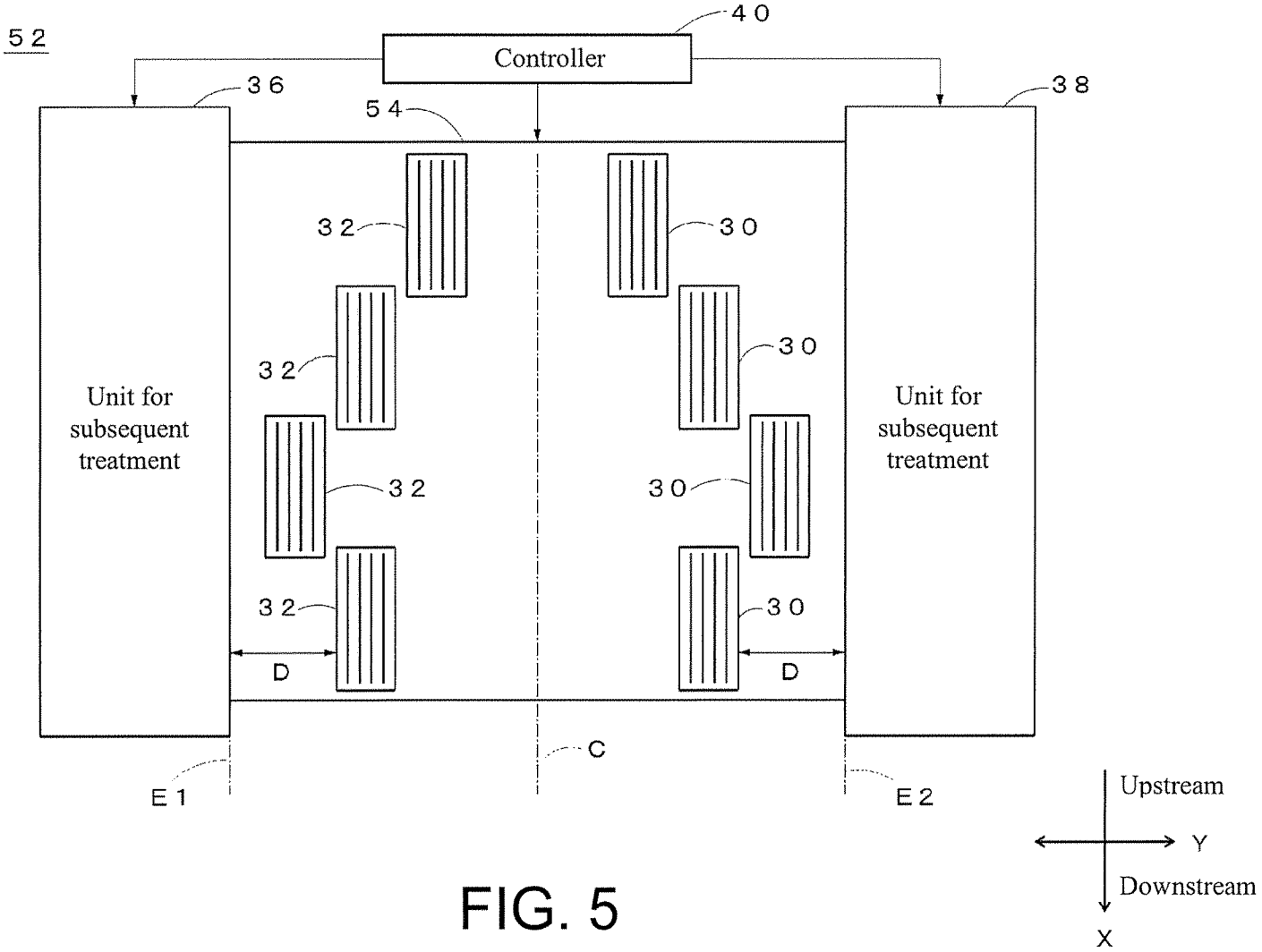
FIG. 5 is an opened-up, schematic plan view of a carriage according to a first modified example.

FIG. 5 is an opened-up, schematic plan view of a carriage 52 according to a first modified example. The carriage 52 has a head holder 54 mounted with four recording heads 30 and four recording heads 32 that are disposed symmetrically with respect to the intermediary line C, as with the first embodiment (FIG. 3). The four recording heads 30 are disposed in a staggered arrangement in three rows along the X direction. The four recording heads 32 are also disposed in a staggered arrangement in three rows along the X direction. An operational effect similar to the first embodiment may be obtained by using the nozzle groups 46 and 48 (FIG. 3) of the recording heads 30 thus staggered in three or more rows.

While D represents a distance between the treatment-starting line E1 and the edge of the recording head 32 most downstream in the X direction closer to the unit for subsequent treatment 36, D also represents a distance between the treatment-starting line E2 and the edge of the recording head 30 most downstream in the X direction closer to the unit for subsequent treatment 38.

The most downstream recording head 32 discharges the droplets 26 that form the uppermost image layer in the forward scans (direction of arrow Y1). The most downstream recording head 30 discharges the droplets 26 that form the uppermost image layer in the backward scans (direction of arrow Y2).

When the carriage 22 moves at a constant speed, the distances D between the recording heads 32, 30 and the treatment-starting lines E1, E2 are proportionate to the waiting time from the droplet landing time to the subsequent treatment starting time. Therefore, a sharp and clear matte image may be obtained when the distance D is decreased, while a less grainy, glossy image may be obtained when the distance D is increased.

[Second Modified Example]

Figure 6:
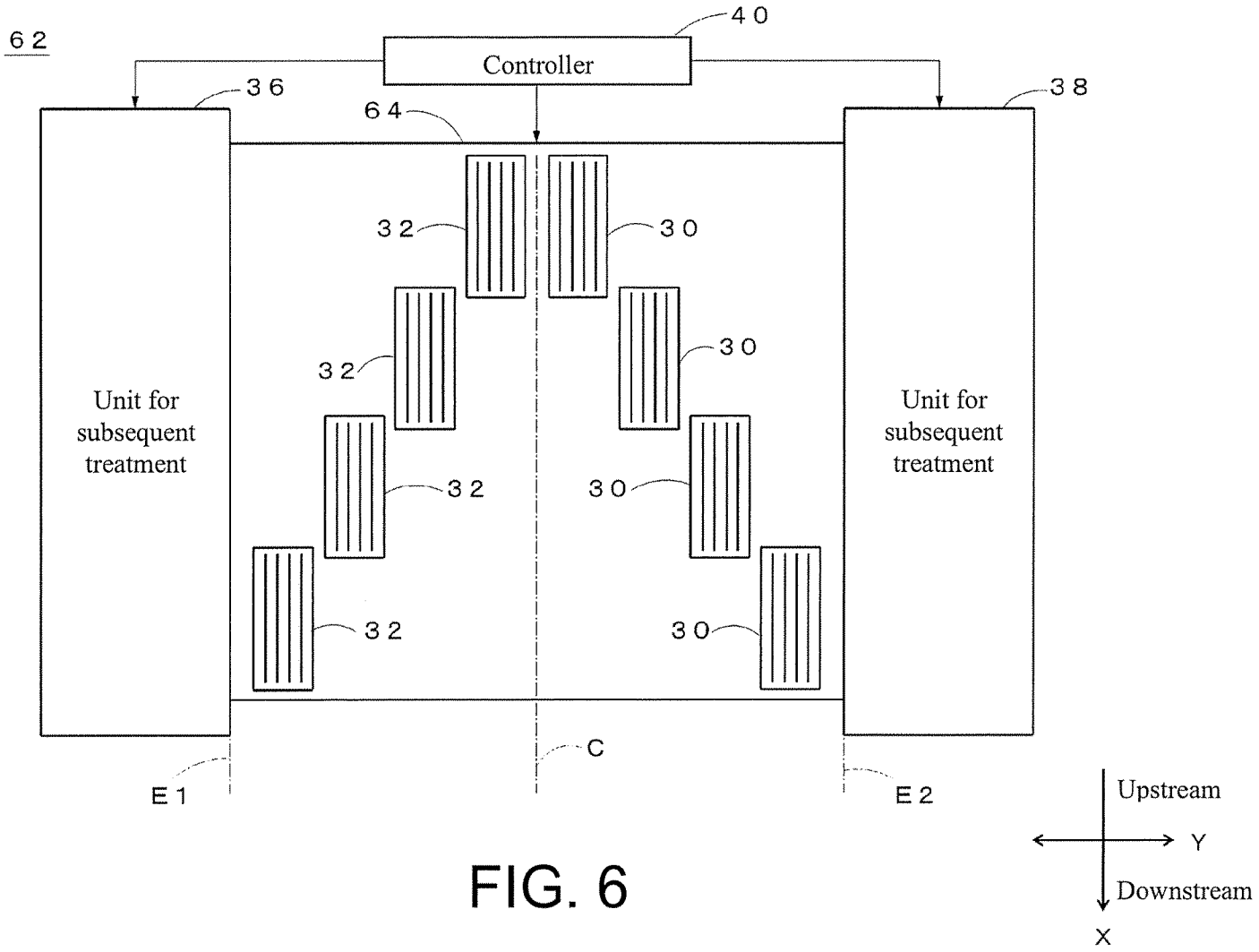
FIG. 6 is an opened-up, schematic plan view of a carriage according to a second modified example.

FIG. 6 is an opened-up, schematic plan view of a carriage 62 according to a second modified example. The carriage 62 has a head holder 64 mounted with four recording heads 30 and four recording heads 32 that are disposed symmetrically with respect to the intermediary line C, as with the first embodiment (FIG. 3).

Among the four recording heads 30 and the four recording heads 32, the paired recording heads 30 and 32 disposed symmetrically with respect to the intermediary line C are more proximate to the intermediary line C in stages from the downstream to upstream side in the X direction. In this instance, the four recording heads 32 are more proximate to the intermediary line C in stages from the downstream to upstream side in the X direction without losing symmetry to the recording heads 30 "paired" with the recording heads 32 with respect to the intermediary line C.

Thus, plural pairs of recording heads 30 and 32 may be arranged, so that a pair of recording heads disposed more downstream in the X direction are more spaced apart, and a pair of recording heads disposed more upstream in the X direction are less spaced apart.

The paired recording heads 30 and 32 more spaced apart are more distant from the intermediary line C and are more proximate to the units for subsequent treatment 36, 38. This may reduce the waiting time to the start of subsequent treatment.

As a result, the flow of droplets 26 that have landed on the downstream side may be comparatively decreased.

One of the pairs of recording heads more spaced apart than the others is disposed downstream in the X direction so as to reduce the flow of ink droplets 26 forming an upper image layer. Then, a sharp and clear matte image may be obtained.

[Third Modified Example]

Figure 7:
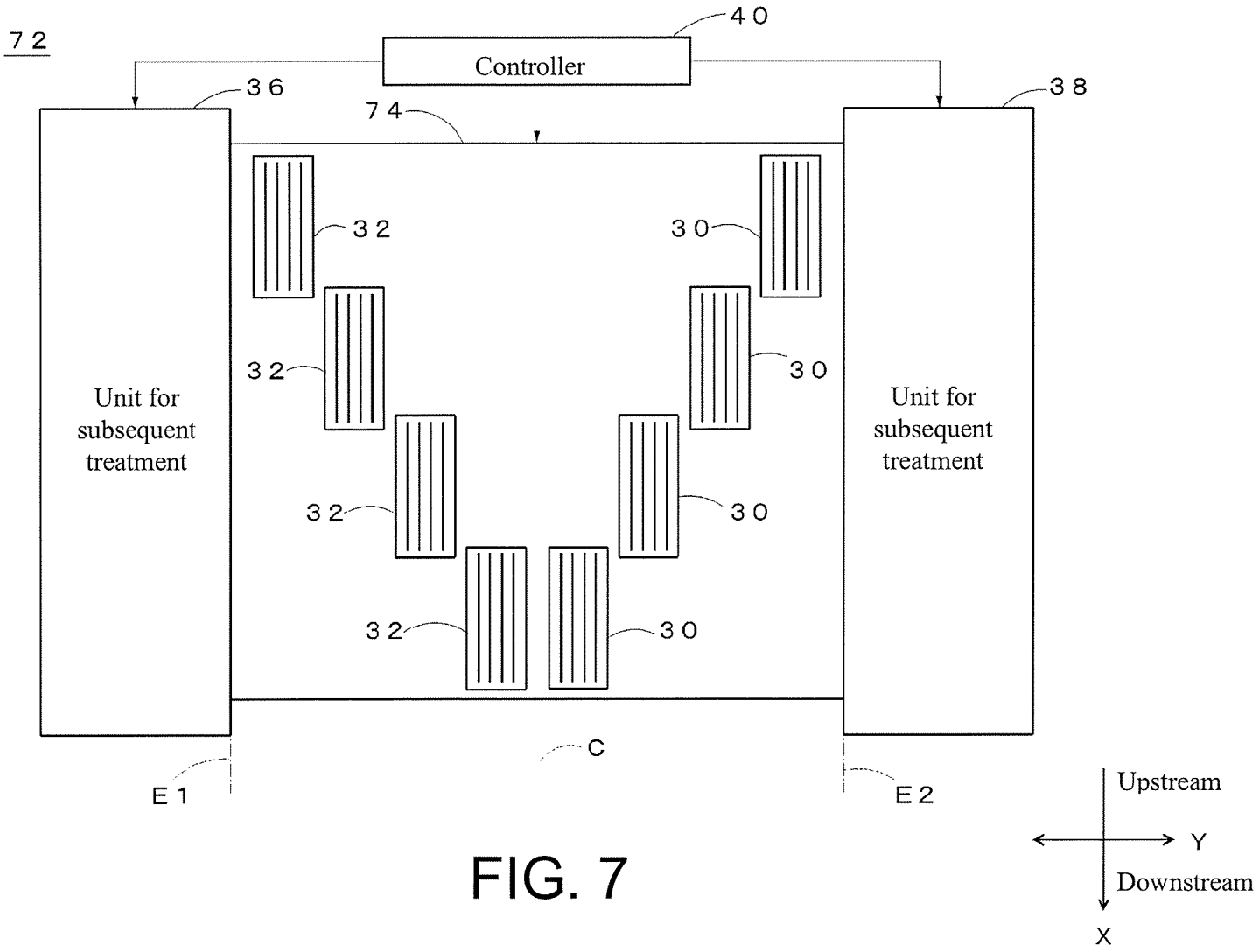
FIG. 7 is an opened-up, schematic plan view of a carriage according to a third modified example.

FIG. 7 is an opened-up, schematic plan view of a carriage 72 according to a third modified example. The carriage 72 has a head holder 74 mounted with four recording heads 30 and four recording heads 32 that are disposed symmetrically with respect to the intermediary line C, as with the first embodiment (FIG. 3).

Among the four recording heads 30 and the four recording heads 32, the paired recording heads 30 and 32 disposed symmetrically with respect to the intermediary line C are more distant from the intermediary line C in stages from the downstream to upstream side in the X direction. In this instance, the four recording heads 32 are more distant from the intermediary line C in stages from the downstream to upstream side in the X direction without losing symmetry to the recording heads 30 "paired" with the recording heads 32 with respect to the intermediary line C.

Thus, plural pairs of recording heads 30 and 32 may be arranged, so that a pair of recording heads disposed more downstream in the X direction are less spaced apart, and a pair of recording heads disposed more upstream in the X direction are more spaced apart.

The paired recording heads 30 and 32 less spaced apart are more proximate to the intermediary line C and are more distant from the units for subsequent treatment 36, 38. This may prolong the waiting time to the start of subsequent treatment.

As a result, the flow of droplets 26 that have landed on the downstream side may be comparatively increased.

One of the pairs of recording heads less spaced apart than the other is disposed downstream in the X direction so as to increase the flow of ink droplets 26 forming an upper image layer. Then, a less grainy, glossy image can be obtained.

[Fourth Modified Example]

Figure 8:
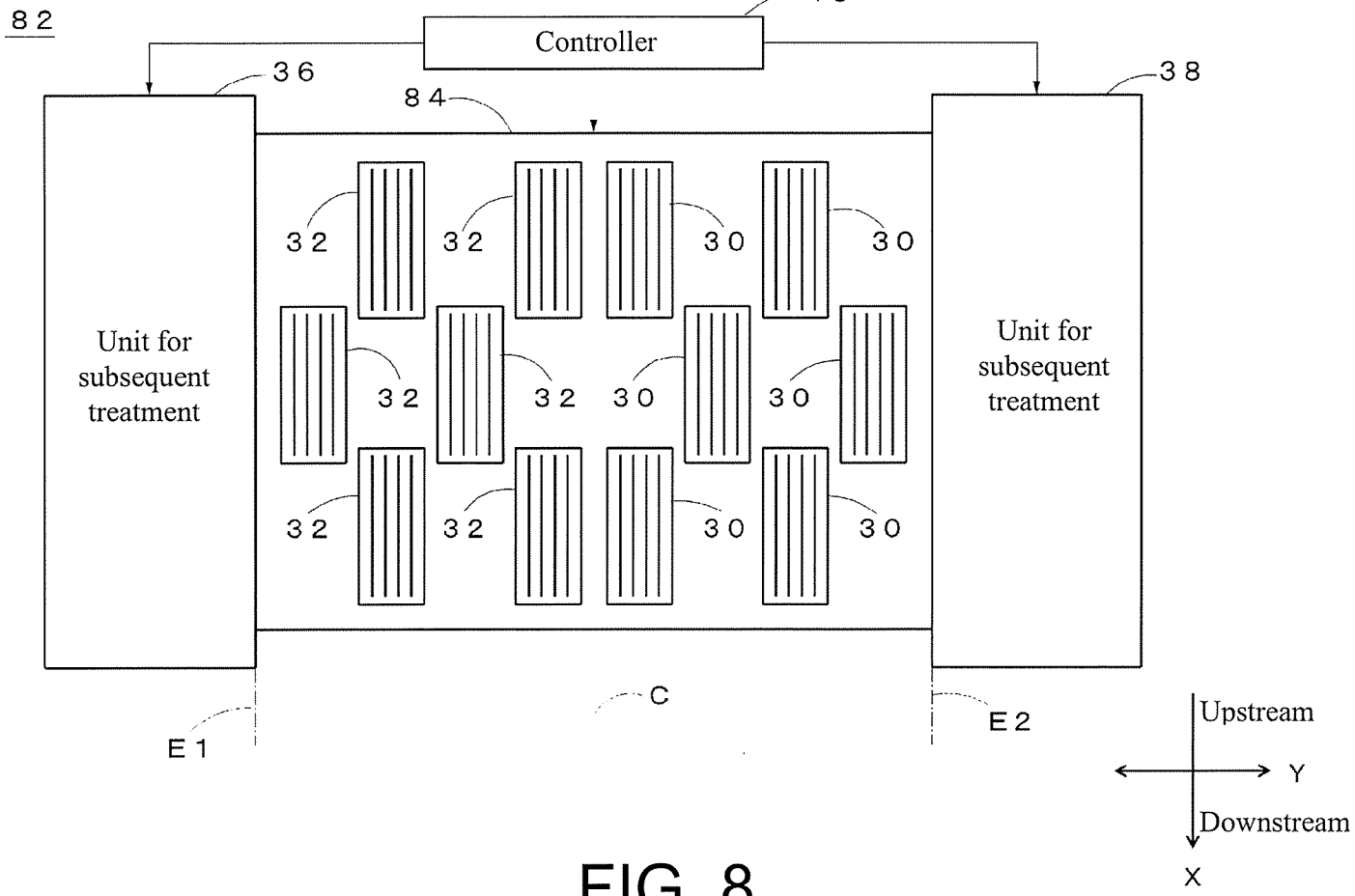
FIG. 8 is an opened-up, schematic plan view of a carriage according to a fourth modified example.

FIG. 8 is an opened-up, schematic plan view of a carriage 82 according to a fourth modified example. The carriage 82 has a head holder 84 mounted with six recording heads 30 and six recording heads 32 that are disposed symmetrically with respect to the intermediary line C. This structure feature; plural "pairs" of recording heads that are disposed at equal positions in the Y direction, may attain an operational effect similar to the first embodiment. Particularly, even when a large number of different color inks (droplets 26) are used, the bidirectional recording mode can be successfully run with less variability in image quality using a comparatively compact configuration.

[Fifth Modified Example]

Figure 9:
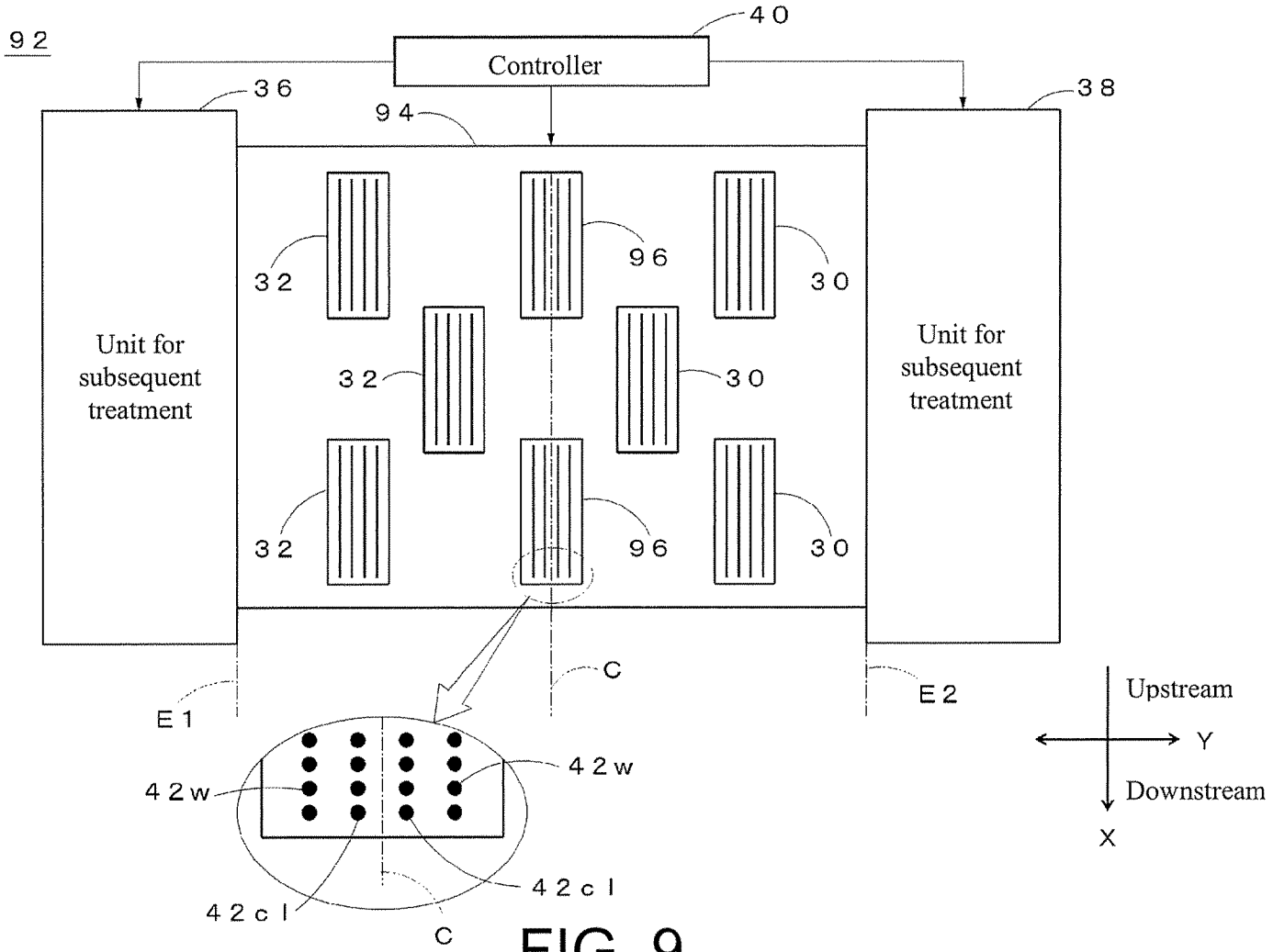
FIG. 9 is an opened-up, schematic plan view of a carriage according to a fifth modified example.

FIG. 9 is an opened-up, schematic plan view of a carriage 92 according to a fifth modified example. The carriage 92 has a head holder 94 mounted with three recording heads 30, three recording heads 32, and two recording heads 96. The three recording heads 30 are disposed in a staggered arrangement in two rows along the X direction. The three recording heads 32 are also disposed in a staggered arrangement in two rows along the X direction. The two recording heads 96 are each disposed in a manner that a center axis extending in a direction in which the nozzle arrays 28 are aligned (Y direction) is coincident with the intermediary line C between the units for subsequent treatment 36 and 38.

The recording heads 96 discharge droplets 26 of two color inks (W, CL) from four nozzle arrays 28 extending along the X direction. The colors of these inks may be selected from, other than W (white) and CL (clear), related colors of the process colors (CMYK) or spot colors such as gold, silver, orange, and violet.

A respective one of the recording heads 96 has, in the order of a position closest to the unit for subsequent treatment 38 to positions closer to the unit for subsequent treatment 36, a nozzle array 28 having nozzle holes 42*w* spaced at equal intervals in the X direction from which the white (W) ink droplets 26 are discharged, a nozzle array 28 having nozzle holes 42*cl* spaced at equal intervals in the X direction from which the clear (cl) ink droplets 26 are discharged, a nozzle array 28 having nozzle holes 42*cl* spaced at equal intervals in the X direction from which the clear (cl) ink droplets 26 are discharged, and a nozzle array 28 having nozzle holes 42*w* spaced at equal intervals in the X direction from which the white (W) ink droplets 26 are discharged.

In this modified example, there are two nozzle groups from which droplets 26 of six color inks are discharged, and the two nozzle groups are symmetric with respect to the intermediary line C. The six color inks are black (K), magenta, (M), cyan (C), yellow (Y), white (W), and clear (CL) inks.

The recording heads 30, 32, 96 may include at least one specified recording head 96 having two or more nozzle arrays 28 in parallel to each other from which droplets 26 of the same color ink are discharged. In this instance, the specified recording heads 96 are disposed in a manner that two or more nozzle arrays 28 are symmetric with respect to the intermediary line C. Even in case of just one recording head 96, the head holder 94 may still ensure line symmetry of the nozzle arrays 28 with respect to the intermediary line C. Then, the number of the recording heads can be reduced and thus the recording head 96 can be more readily adjusted in position and orientation than two or more recording heads 96.

[Sixth Modified Example]

The units for subsequent treatment 36 and 38 apply an energy to the droplets 26 to subject the ink dots to subsequent treatment. The subsequent treatment is specifically to deprive a liquid ink of fluidity or lessen the fluidity. The energy may be electromagnetic wave including ultraviolet light (light energy), or thermal energy. In a case where a solvent-containing ink needs to be heated to volatilize the solvent to deprive the ink of fluidity, a heater may be installed in the unit(s) for subsequent treatment 36 and/or 38.

Second Embodiment

Next, an inkjet recording apparatus 110 according to a second embodiment of this invention is hereinafter described referring to FIGS. 1, 2, 10, 11A and 11B.

[Configuration of Inkjet Recording Apparatus 110]

As illustrated in FIGS. 1 and 2, the inkjet recording apparatus 110 is provided with a carriage 112 (see FIG. 10) instead of the carriage 22, which is a difference to the first embodiment. Any other structural elements of this apparatus are essentially the same as described in the first embodiment, and description of such like components will be omitted.

[Configuration of Carriage 112]

Figure 10:
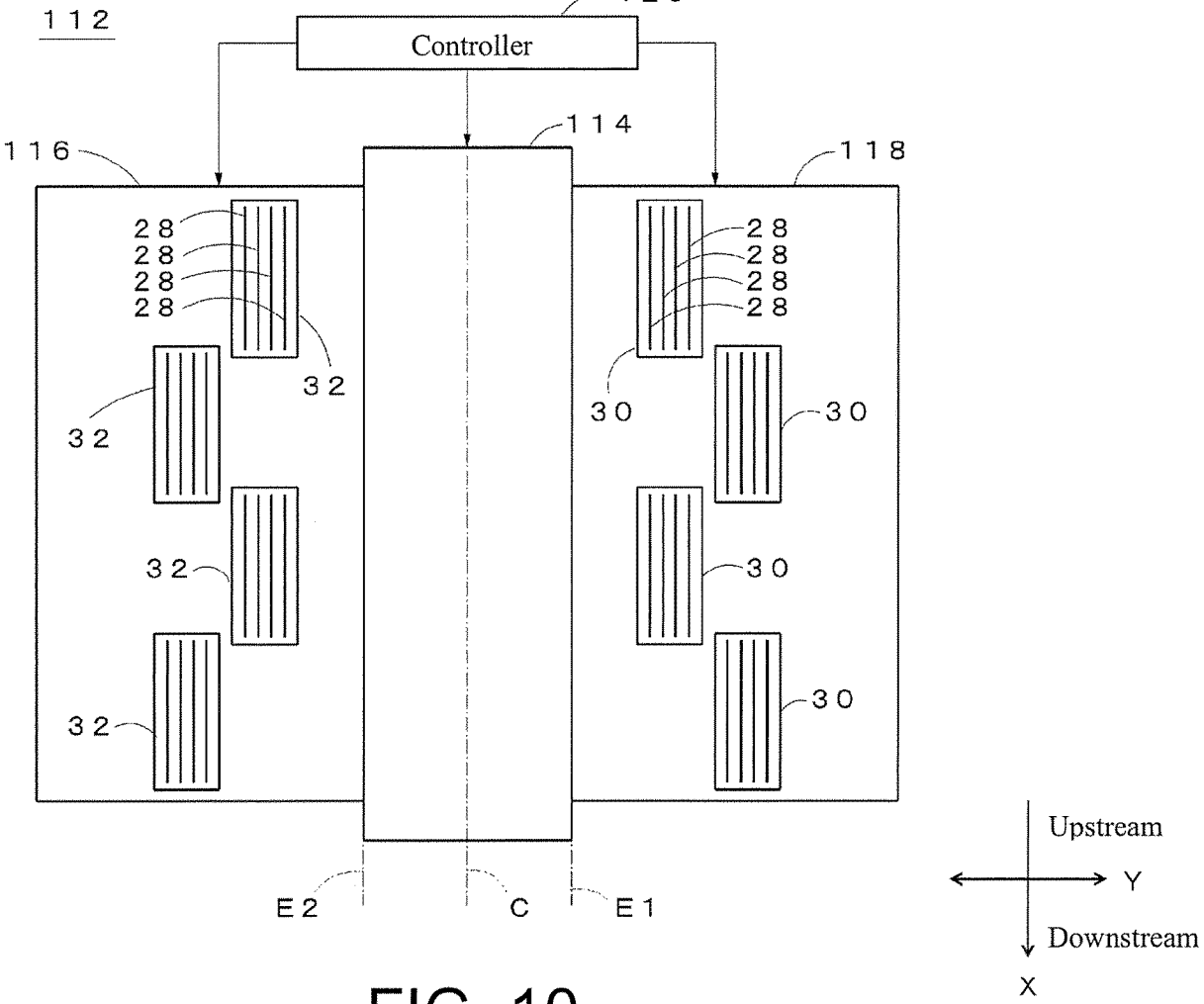
FIG. 10 is an opened-up, schematic plan view of a carriage according to a second embodiment of this invention.

FIG. 10 is an opened-up, schematic plan view of the carriage 112 according to the second embodiment. Inside the cabinet of the carriage 112, four recording heads 30 and four recording heads 32 each having nozzle arrays 28 are provided. At substantially the center of the carriage 112, a unit for subsequent treatment 114 is provided. The carriage 112 has a head holder 116 and a head holder 118 that are rectangular in plan view. The four recording heads 32 are held in the head holder 116, and the four recording heads 30 are held in the recording head 118. The head holders holding these recording heads are securely housed in the carriage.

The recording heads 30 and 32 and the unit for subsequent treatment 114 are electrically connected to a controller 120 installed in the printer body 14. The controller 120 includes CPU and RAM. The controller 120 controls operations, including ink discharge from the recording heads 30 and 32 and light radiation from the unit for subsequent treatment 114.

The recording heads 30 and 32 each have four nozzle arrays 28 extending along the X direction and spaced at an interval in parallel to each other in the Y direction. The droplets 26 of four color inks (CMYK) are discharged from the four nozzle arrays 28. The unit for subsequent treatment 114 is substantially rectangular in plan view, and includes a light source unit that radiates ultraviolet light toward the droplets 26 on the recording medium 12. The recording heads 30 and 32 and the unit for subsequent treatment 114 may be configured similarly to the first embodiment.

The unit for subsequent treatment 114 is linearly disposed along the X direction. Hereinafter, an edge of the unit for subsequent treatment 114 closer to the recording heads 30 is referred to as a "treatment-starting line E1", and the other edge of the unit for subsequent treatment 114 closer to the recording heads 32 is referred to as a "treatment-starting line E2". A straight line passing through the center of an interval between the treatment-starting lines E1 and E2 and extending in the X direction is an "intermediary line C" passing through the center in width of the unit for subsequent treatment 114.

As is known from the drawings, the recording heads 30 and 32 (eight recording heads in total) are disposed symmetrically with respect to the intermediary line C. The distinctive shapes and positions of the recording heads 30, 32 and nozzle arrays 28 are basically the same as in the first embodiment (see FIG. 3). There are two nozzle groups 46 and 48 from which droplets 26 of the same color ink are discharged, and these nozzle groups 46 and 48 (see FIGS. 11A and 11B) are symmetric with respect to the intermediary line C.

The unit for subsequent treatment 114 has a length in the X direction greater than an ink-dischargeable extent in the X direction of the recording heads 30, 32 in one scan. The ink-dischargeable extent corresponds to a distance between the nozzles 42*k* most upstream and most downstream, respectively, in the X direction in two or more recording heads 30 and 32 in one nozzle group 46, 48.

[Operation of Inkjet Recording Apparatus 110]

The inkjet recording apparatus 110 according to the second embodiment is configured as described so far. Next, the operation of the inkjet recording apparatus 110 is hereinafter described referring to FIGS. 11A and 11B.

The controller 120 (FIG. 10) converts an image signal inputted from an outer source into desired print data and generates control signals for the recording heads 30 and 32 based on the generated print data. Then, the inkjet recording apparatus 110 carries out printing operation to form a color image on the recording medium 12. Prior to the printing operation, a recording mode; unidirectional recording mode or bidirectional recording mode, is selected and set.

Figure 11A:
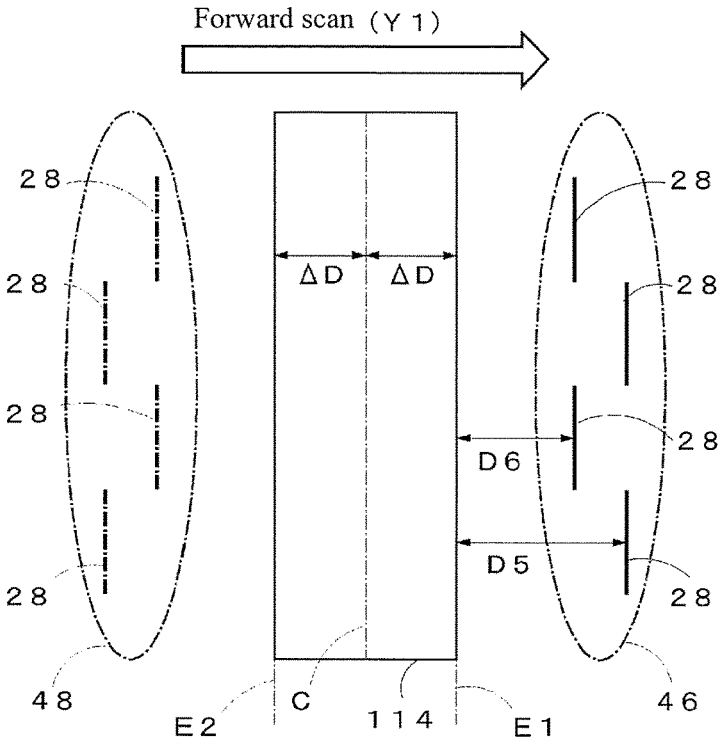
FIGS. 11A and 11B are drawings that illustrate an image formation process in a bidirectional recording mode according to the second embodiment.
Figure 11B:
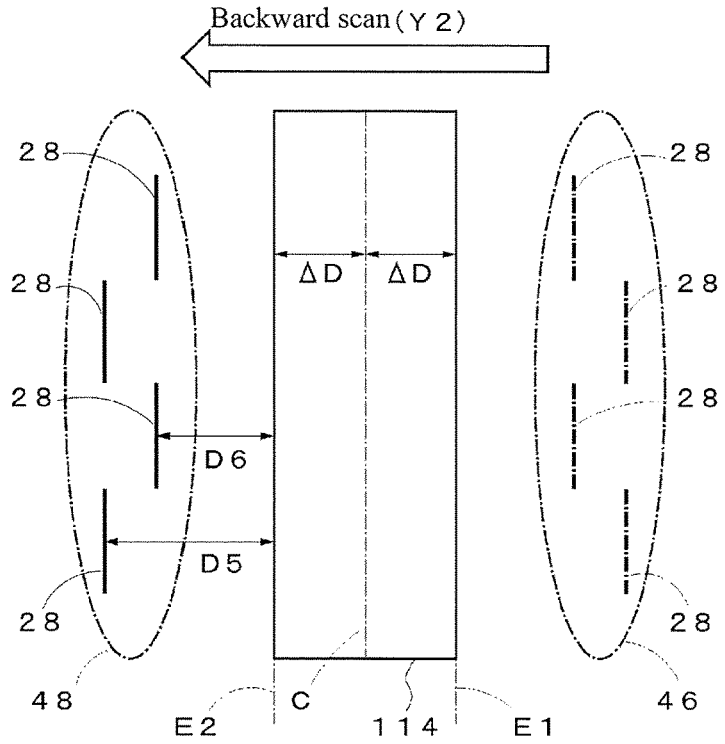

FIGS. 11A and 11B are drawings that illustrate an image formation process in the bidirectional recording mode according to the second embodiment. FIG. 11A is a drawing that illustrates a forward scan (in the direction of arrow Y1). FIG. 11B is a drawing that illustrates a backward scan (in the direction of arrow Y2). These drawings schematically illustrate a relationship in position alone among the unit for subsequent treatment 114 and the nozzle arrays 28 from which the droplets 26 of a certain color (for example, black (K)) are discharged. The intermediary line C is a line by which a width in the Y direction of the unit for subsequent treatment 114 (2ΔD) is divided in two equal halves.

In FIG. 11A, the nozzle arrays 28 from which the droplets 26 are discharged in forward scans by the carriage 112, i.e., one side closer to the treatment-starting line E1 (nozzle group 46), is illustrated with a solid line, while the nozzle arrays 28 from which the ink droplets 26 are not discharged in forward scans by the carriage 112, i.e., the other side closer to the treatment-starting line E2 (nozzle group 48), is illustrated with a long-short dashed line.

The ink droplets 26 discharged from the nozzle group 46 land on a surface of the recording medium 12 and spreads on the surface by degrees over time. The carriage 112 moves in the direction of arrow Y1, and the unit for subsequent treatment 114 accordingly arrives at the position of the droplets 26 that have landed on the medium. As prompted by an instruction to radiate light outputted from the controller 120, the unit for subsequent treatment 114 irradiates the droplets 26 at the landing position with ultraviolet light to cure the droplets 26 as subsequent treatment.

While D5 represents a distance between the treatment-starting line E1 and the first nozzle array 28 downstream the X direction of the nozzle group 46, D6 (<D5) represents a distance between the treatment-starting line E1 and the second nozzle array 28 downstream in the X direction of the nozzle group 46.

In FIG. 11B, the nozzle arrays 28 from which the droplets 26 are discharged in backward scans by the carriage 112, i.e., the nozzle arrays 28 closer to the treatment-starting line E2 (nozzle group 48) are illustrated with a solid line, while the nozzle arrays 28 from which the ink droplets 26 are not discharged in backward scans by the carriage 112, i.e., the nozzle arrays 28 closer to the treatment-starting line E1 (nozzle group 46) are illustrated with a long-short dashed line.

The droplets 26 discharged from the nozzle group 48 land on a surface of the recording medium 12 and spreads on the surface by degrees over time. The carriage 112 moves in the direction of arrow Y2, and the unit for subsequent treatment 114 accordingly arrives at the position of the droplets 26 that have landed on the medium. As prompted by an instruction to radiate light outputted from the controller 120, the unit for subsequent treatment 114 irradiates the droplets 26 at the landing position with ultraviolet light to cure the droplets 26 as subsequent treatment.

In this instance, a distance between the treatment-starting line E2 and the first nozzle array 28 downstream in the X direction of the nozzle group 48 (D5) is the same as in the forward scan (FIG. 11A). Similarly, a distance between the treatment-starting line E2 and the second nozzle array 28 downstream in the X direction of the nozzle group 48 (D6) is the same as in the forward scan (FIG. 11A). (D5>D6)

[Effects of Second Embodiment]

The inkjet recording apparatus 110 includes recording heads 30 and 32, a unit for subsequent treatment 114, and a controller 120. The recording heads 30 and 32 each have two or more nozzle arrays 28 from which the ink droplets 26 are discharged. The unit for subsequent treatment 114 radiates ultraviolet light toward the droplets 26 on the recording medium 12 discharged from the recording heads 30 and 32, thereby carrying out the subsequent treatment on the ink dots. The controller 40 prompts the recording heads 30 and 32, while reciprocating them in the Y direction, to discharge the droplets 26 at timings of the forward and backward scans being performed to form an image with the ink dots on the recording medium 12.

Two or more recording heads 30 and 32 are disposed in a staggered arrangement in the X and Y directions.

The unit for subsequent treatment 114 is linearly disposed along the X direction.

The length of the unit for subsequent treatment 114 in the X direction is greater than or equal to the ink-dischargeable extent in the X direction of the recording head 30, 32 in one scan.

The recording heads 30 and 32 are arranged, so that two or more nozzle arrays (nozzle group 46, 48), from which the ink droplets 26 of the same color (for example, black) are discharged, are disposed symmetrically with respect to the intermediary line C of the unit for subsequent treatment 114.

Thus structured, the distance between the unit for subsequent treatment 114 and the nozzle group 46 on one side of the intermediary line C and the distance between the unit for subsequent treatment 114 and the nozzle group 48 on the other side of the intermediary line C are equal.

Then, a substantially constant waiting time is provided, regardless of the forward or backward scan being performed, from a point in time when the droplets 26 discharged through nozzle holes of the nozzle groups 46, 48 land on the recording medium 12 to a point in time when the subsequent treatment by the unit for subsequent treatment 114 starts to be exercised.

Two or more of the recording heads 30 and 32 are disposed in a staggered arrangement. This may ensure symmetry of the nozzle groups 46 and 48 in the recording heads 30 and 32 with respect to the intermediary line C.

Even in case of any change in the arrangement and/or number of the recording heads 30 and 32, no design change may be necessary for the subsequent treatment by the unit for subsequent treatment 114.

This may facilitate designing of the unit for subsequent treatment 114 in terms of its shape and/or position, while suppressing variability in image quality resulting from the subsequent treatment.

[Modified Example of Second Embodiment]

The first through six modified examples described earlier may be optionally combined and used in the inkjet recording apparatus 110 according to the second embodiment, unless they present any technical inconsistency. Specifically, the first modified example (FIG. 5), second modified example (FIG. 6), third modified example (FIG. 7), fourth modified example (FIG. 8), and six modified example are applicable to the inkjet recording apparatus 110.

[Remarks]

It should be understood that this invention is not necessarily limited to the embodiments and modified examples described herein and may be optionally subject to changes within the scope and spirit of this invention.

The invention claimed is:

1. An inkjet recording apparatus, comprising:

a plurality of recording heads each having at least a nozzle array from which droplets of an ink are discharged;

a pair of units for subsequent treatment that apply an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium, wherein two or more than two of the plurality of recording heads being disposed in a staggered arrangement in the first direction and a second direction intersecting the first direction, the pair of units for subsequent treatment being disposed along the second direction and spaced at an interval with the plurality of recording heads being interposed therebetween, a respective one of the pair of units for subsequent treatment having a length in the second direction greater than or equal to an ink-dischargeable extent in the second direction of the plurality of recording heads in one scan, and two or more than two nozzle arrays of the plurality of recording heads, from which droplets of a same color ink are discharged, being disposed symmetrically with respect to an intermediary line extending along the second direction and passing through center of the interval between the pair of units for subsequent treatment that are spaced apart;

wherein the plurality of recording heads comprises at least a pair of recording heads having two or more than two nozzle arrays disposed in parallel to each other from which droplets of different color inks are discharged, and the two or more than two nozzle arrays are disposed symmetrically with respect to the intermediary line for each color of the droplets;

the plurality of recording heads comprise: a plurality of pairs of recording heads, one of the pairs of recording heads disposed downstream in the second direction are spaced apart by a longer distance in the first direction, and another one of the pairs of recording heads disposed upstream in the second direction are spaced apart by a shorter distance in the first direction.

2. The inkjet recording apparatus as set forth in claim 1, wherein of the nozzle arrays in the pair of recording heads, droplets of a color ink with lower luminosity are discharged from the nozzle array closer to the intermediary line, and droplets of a color ink with higher luminosity are discharged from the nozzle array farther from the intermediary line.

3. The inkjet recording apparatus as set forth in claim 1, wherein the plurality of recording heads comprise: at least one specified recording head having two or more than two of the nozzle arrays from which droplets of a same color ink are discharged, two or more than two of the nozzle arrays being spaced at an interval in parallel to each other in the first direction, and two or more than two of the nozzle arrays of the specified recording head are disposed symmetrically with respect to the intermediary line.

4. The inkjet recording apparatus as set forth in claim 1, further comprising:

a carriage by which the plurality of recording heads and the pair of units for subsequent treatment are securely positioned.

5. An inkjet recording apparatus, comprising:

a plurality of recording heads each having at least a nozzle array from which droplets of an ink are discharged;

a pair of units for subsequent treatment that apply an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium, wherein two or more than two of the plurality of recording heads being disposed in a staggered arrangement in the first direction and a second direction intersecting the first direction, the pair of units for subsequent treatment being disposed along the second direction and spaced at an interval with the plurality of recording heads being interposed therebetween, a respective one of the pair of units for subsequent treatment having a length in the second direction greater than or equal to an ink-dischargeable extent in the second direction of the plurality of recording heads in one scan, and two or more than two nozzle arrays of the plurality of recording heads, from which droplets of a same color ink are discharged, being disposed symmetrically with respect to an intermediary line extending along the second direction and passing through center of the interval between the pair of units for subsequent treatment that are spaced apart;

wherein the plurality of recording heads comprises at least a pair of recording heads having two or more than two nozzle arrays disposed in parallel to each other from which droplets of different color inks are discharged, and the two or more than two nozzle arrays are disposed symmetrically with respect to the intermediary line for each color of the droplets;

the plurality of recording heads comprise: a plurality of pairs of recording heads, one of the pairs of recording heads disposed downstream in the second direction are spaced apart by a shorter distance in the first direction, and another one of the pairs of recording heads disposed upstream in the second direction are spaced apart by a longer distance in the first direction.

6. The inkjet recording apparatus as set forth in claim 5, wherein of the nozzle arrays in the pair of recording heads, droplets of a color ink with lower luminosity are discharged from the nozzle array closer to the intermediary line, and droplets of a color ink with higher luminosity are discharged from the nozzle array farther from the intermediary line.

7. The inkjet recording apparatus as set forth in claim 5, wherein the plurality of recording heads comprise: at least one specified recording head having two or more than two of the nozzle arrays from which droplets of a same color ink are discharged, two or more than two of the nozzle arrays being spaced at an interval in parallel to each other in the first direction, and two or more than two of the nozzle arrays of the specified recording head are disposed symmetrically with respect to the intermediary line.

8. The inkjet recording apparatus as set forth in claim 5, further comprising:

a carriage by which the plurality of recording heads and the pair of units for subsequent treatment are securely positioned.

9. An inkjet recording apparatus, comprising:

a plurality of recording heads each having at least a nozzle array from which droplets of an ink are discharged;

a pair of units for subsequent treatment that apply an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium, wherein two or more than two of the plurality of recording heads being disposed in a staggered arrangement in the first direction and a second direction intersecting the first direction, the pair of units for subsequent treatment being disposed along the second direction and spaced at an interval with the plurality of recording heads being interposed therebetween, a respective one of the pair of units for subsequent treatment having a length in the second direction greater than or equal to an ink-dischargeable extent in the second direction of the plurality of recording heads in one scan, and two or more than two nozzle arrays of the plurality of recording heads, from which droplets of a same color ink are discharged, being disposed symmetrically with respect to an intermediary line extending along the second direction and passing through center of the interval between the pair of units for subsequent treatment that are spaced apart;

wherein the plurality of recording heads comprises at least a pair of recording heads having two or more than two nozzle arrays disposed in parallel to each other from which droplets of different color inks are discharged, and the two or more than two nozzle arrays are disposed symmetrically with respect to the intermediary line for each color of the droplets;

wherein of the nozzle arrays in the pair of recording heads, droplets of a color ink with lower luminosity are discharged from the nozzle array closer to the intermediary line, and droplets of a color ink with higher luminosity are discharged from the nozzle array farther from the intermediary line.

10. The inkjet recording apparatus as set forth in claim 9, wherein the plurality of recording heads comprise: at least one specified recording head having two or more than two of the nozzle arrays from which droplets of a same color ink are discharged, the two or more than two nozzle arrays being spaced at an interval in parallel to each other in the first direction, and two or more than two of the nozzle arrays of the specified recording head are disposed symmetrically with respect to the intermediary line.

11. The inkjet recording apparatus as set forth in claim 10, further comprising:

a carriage by which the plurality of recording heads and the pair of units for subsequent treatment are securely positioned.

12. An inkjet recording apparatus, comprising:

a plurality of recording heads each having at least a nozzle array from which droplets of an ink are discharged;

a pair of units for subsequent treatment that apply an energy to the droplets discharged from the plurality of recording heads onto a recording medium to exercise subsequent treatment for dots formed with the ink; and a controller that, while reciprocating the plurality of recording heads along a first direction, prompts the plurality of recording heads to discharge the droplets onto the recording medium at timings of forward and backward scans being performed in order to obtain an image formed with the dots on the recording medium, wherein two or more than two of the plurality of recording heads being disposed in a staggered arrangement in the first direction and a second direction intersecting the first direction, the pair of units for subsequent treatment being disposed along the second direction and spaced at an interval with the plurality of recording heads being interposed therebetween, a respective one of the pair of units for subsequent treatment having a length in the second direction greater than or equal to an ink-dischargeable extent in the second direction of the plurality of recording heads in one scan, and two or more than two nozzle arrays of the plurality of recording heads, from which droplets of a same color ink are discharged, being disposed symmetrically with respect to an intermediary line extending along the second direction and passing through center of the interval between the pair of units for subsequent treatment that are spaced apart;

wherein the plurality of recording heads comprise: at least one specified recording head having two or more than two of the nozzle arrays from which droplets of a same color ink are discharged, two or more than two of the nozzle arrays being spaced at an interval in parallel to each other in the first direction, and two or more than two of the nozzle arrays of the specified recording head are disposed symmetrically with respect to the intermediary line.

13. The inkjet recording apparatus as set forth in claim 12, wherein wherein the plurality of recording heads comprises at least a pair of recording heads having two or more than two nozzle arrays disposed in parallel to each other from which droplets of different color inks are discharged, and the two or more than two nozzle arrays are disposed symmetrically with respect to the intermediary line for each color of the droplets.

* * * * *